United States Patent [19]

Chierici et al.

[11] 4,055,254

[45] Oct. 25, 1977

[54] SELF LUBRICATING YOKE WEAR PLATE ARRANGEMENT

[75] Inventors: Osvaldo F. Chierici, Elmhurst; Richard F. Murphy, Aurora, both of Ill.

[73] Assignee: Holland Company, Lombard, Ill.

[21] Appl. No.: 713,189

[22] Filed: Aug. 10, 1976

[51] Int. Cl.[2] ..... B61G 7/10

[52] U.S. Cl. ..... 213/61; 213/21; 213/51

[58] Field of Search ..... 213/8, 20, 21, 50, 51, 213/60, 61, 62 R, 62 A, 67 R, 67 A, 69

[56] References Cited

U.S. PATENT DOCUMENTS

| | | | |
|---|---|---|---|
| 1,871,427 | 8/1932 | Schulz | 213/61 |
| 2,431,864 | 12/1947 | Dean | 213/61 |
| 2,889,940 | 6/1959 | Metzger | 213/69 |
| 3,240,354 | 3/1966 | Williams | 213/21 |
| 3,610,436 | 10/1971 | Wisler | 213/62 A |

*Primary Examiner*—Trygve M. Blix
*Assistant Examiner*—Stuart M. Goldstein
*Attorney, Agent, or Firm*—McWilliams & Mann

[57] ABSTRACT

A self lubricating wear plate arrangement for supporting the inner end of the vertical yoke used in coupler draft gear rigging in which the wear plate is in the form of a planar support plate equipped with a special liner for supporting the yoke inner end at its operative level within the car center sill. The liner is formed from an ultra high molecular weight polymer material that is of dry, self lubricating, nature and resists adherence thereto of foreign materials and serves as a sound deadener and energy absorber. Such material is also characterized by its polishing action on the yoke underside surface portion riding on same to re-form such yoke surface to define a mirror finish for inhibiting further wear of the yoke at this location during use.

7 Claims, 6 Drawing Figures

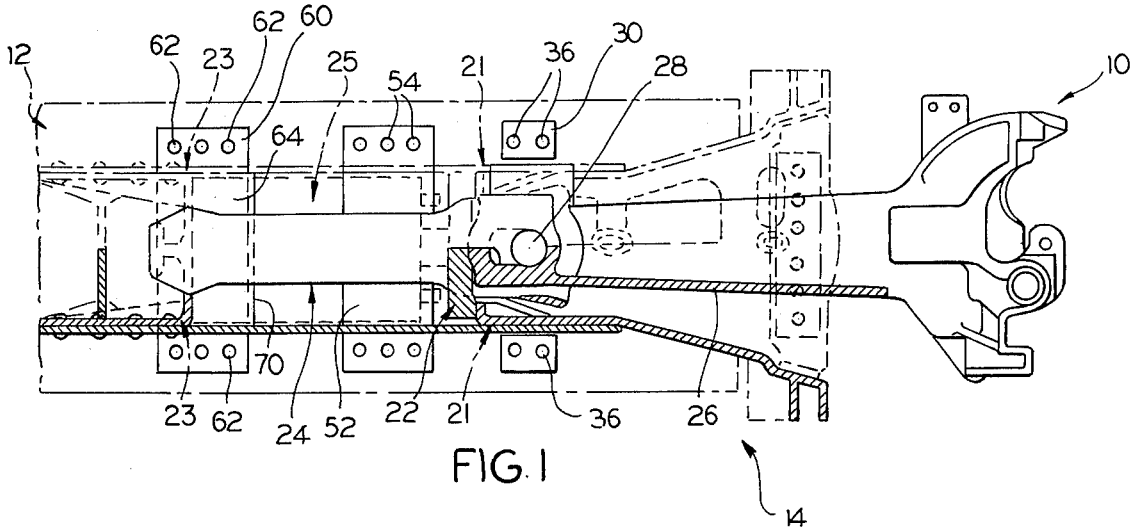
FIG. 1
FIG. 2
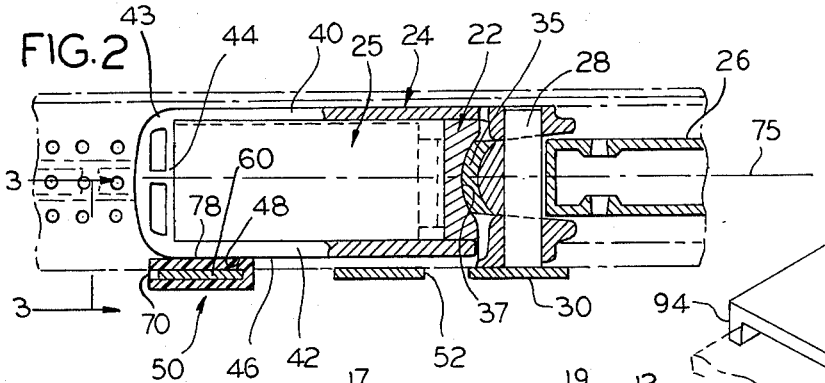
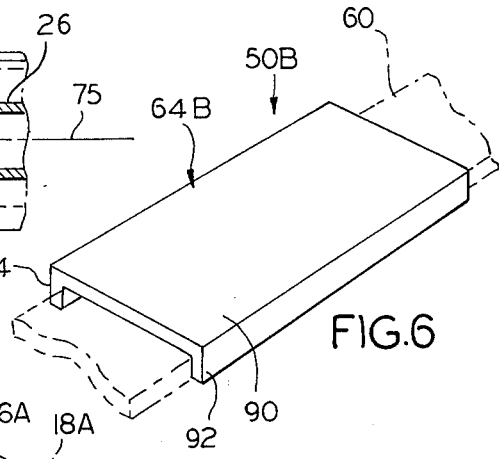
FIG. 6
FIG. 3
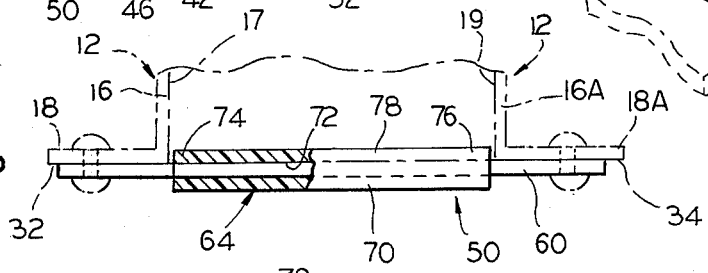
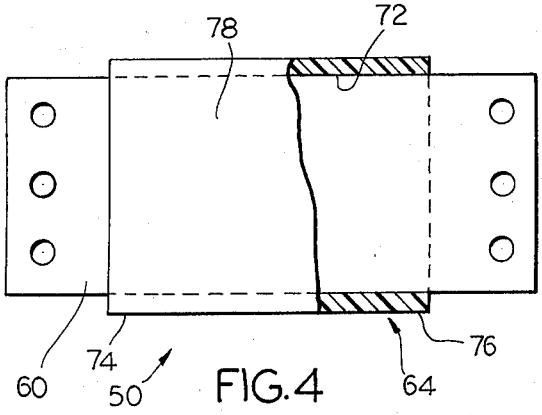
FIG. 4
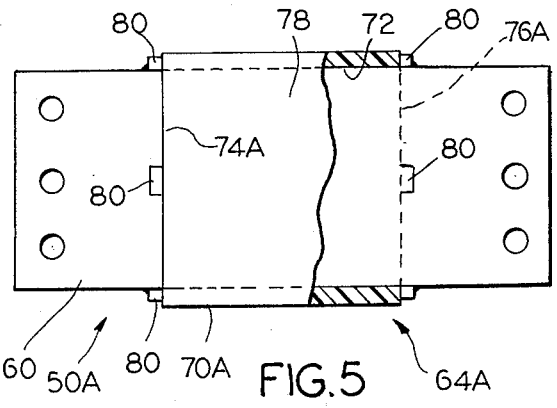
FIG. 5

SELF LUBRICATING YOKE WEAR PLATE ARRANGEMENT

This invention relates to a self lubricating wear plate arrangement for railroad car draft gear rigging yokes, and more particularly, to a self lubricating wear plate arrangement for supporting the inner end of the yoke of coupler draft gear rigging.

Draft gear rigging for, for instance, AAR type F interlocking couplers conventionally comprises a draft gear applied within the center sill draft gear pocket, between pairs of stop lugs fixed to the center sill on either side of same, which pairs of stop lugs are spaced apart longitudinally of the center sill. The draft gear is embraced by a vertical yoke extending longitudinally of the car and operably connected to the coupler by a vertical connector pin that is supported by and rides on a support plate secured across the underside of the center sill and also supporting the outer end of the yoke. The inner end of the yoke is supported by and rides on a wear plate that is secured across the underside of the center sill, and it is upwardly indented to dispose the yoke inner end in proper working alignment level with the coupler longitudinally of the center sill. Additionally and conventionally, a flat safety plate is secured across the underside of the center sill between the connector pin support plate and the yoke wear plate, this safety plate normally being disposed below and spaced from the underside of the yoke.

As the draft gear operates to accommodate buff and draft impacts acting on the coupler, the yoke slides back and forth on its wear plate, which results in wear on both the wear plate and yoke that is accentuated by a downward acting vector in the forces acting on the wear plate, due to the location of the yoke wear plate at the inner end of the yoke. While the yoke wear plates are relatively easy to replace, the yokes themselves are not because of their embracing relation with the draft gear. AAR regulations require that when the yoke at its inner end has worn away about ⅜ths of an inch, the yoke must be repaired or replaced.

This required repair or replacement of the yoke necessarily involves shopping of the car for removal of the draft gear rigging and separation of the yoke from the draft gear, so that the yoke can be replaced or serviced. The worn yoke is conventionally restored to working condition by filling in its worn area with weld material, grinding down the surface involved to the needed level, and then suitably heat treating the yoke to get the repaired area of same to the required hardness. After these time consuming procedures, the yoke is then available for re-use.

The familiar AAR type E coupler draft rigging arrangement involves the familiar horizontal key connecting the yoke to the coupler, with the yoke resting on one or more wear plates secured across the underside of the center sill and either upwardly indented or built up within the center sill, to dispose the yoke in proper working alignment level with the coupler, longitudinally of the center sill. The wearing action on the yoke in these arrangements presents the same problems referred to above with regard to yoke and wear plate replacement.

A principal object of the present invention is to provide a wear plate arrangement for supporting the yoke, in which metal wear between the yoke and its wear plate is essentially eliminated, after the yoke surfacing involved has been resurfaced by polishing to a mirror finish as a result of normal operation of the rigging.

Another principal object of the present invention is to provide a self lubricating liner arrangement for the yoke wear plate which is characterized both by dry lubrication and a re-surfacing of the yoke underside during normal use of the draft gear rigging that provides the surfacing of the yoke which rides on its wear plate, with a wear resisting mirror like finish.

Still other objects of the invention are to provide a yoke wear plate arrangement that avoids the need for a special upward indentation in the wear plate or building up of same to dispose the yoke at its needed operating level, to provide a liner arrangement for yoke wear plates formed of a material characterized by being resistant to adherence of foreign matter thereto, and to provide a yoke wear plate arrangement of the type indicated that is economical of manufacture, easy to install in both new and used equipment, and long lived in operation.

In accordance with the present invention, the conventional yoke wear plate of draft rigging for AAR type interlocking couplers is replaced by a wear plate assembly comprising a planar support plate that is secured at the same position as a conventional yoke wear plate, and that is equipped with a special liner for supporting the yoke inner end at its operative level within the car center sill. The liner is formed from an ultra high molecular weight polymer material that is of dry self lubricating nature, and resists adherence thereto of foreign material. The material from which the liner is formed is also characterized by its tendency to reform the yoke underside surface portion riding on same whereby such yoke underside surface portion defines a mirror finish that acts to inhibit further wear of the yoke during use.

The liner, which may be of either plate or tubular form, is applied to the planar support plate so that the liner material is interposed between the yoke and the new support plate in question. The new wear plate assembly is equipped to have the liner centered with respect to the yoke and center sill.

Other objects, uses, and advantages will be obvious or become apparent from a consideration of the following detailed description and the application drawings in which like reference numerals are employed to indicate like parts throughout the several views.

In the drawings:

FIG. 1 is a diagrammatic plan view, partially in section, illustrating a typical mounting arrangement of an AAR type F interlocking coupler and draft rigging therefor, with parts being shown in phantom;

FIG. 2 is a vertical sectional view through the draft rigging and associated parts shown in FIG. 1, with parts being shown in phantom and the draft gear being shown in block diagram form;

FIG. 3 is a fragmental view taken substantially along line 3—3 of FIG. 2, showing one wear plate assembly arranged in accordance with the invention, with the wear plate liner partially broken away, and the center sill shown in phantom;

FIG. 4 is a plan view of the wear plate assembly shown in FIG. 3, with the liner shown partially broken away;

FIG. 5 is a view similar to that of FIG. 4 but illustrating a modified form of wear plate assembly; and FIG. 6 is a perspective view of still another form of wear plate assembly arranged in accordance with the invention.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Reference numeral 10 of FIG. 1 generally indicates an AAR type F interlocking coupler applied to conventional center sill 12 that is an integral part of railroad car body 14 (the latter being largely omitted except for the relevant parts in the area of the operating location of the coupler 10).

The center sill 12 is of the usual inverted channel shape type, defining spaced wide walls 16 and 16A each having laterally directed end flanges 18 and 18A.

The respective center sill side walls 16 and 16A each have applied to same, spaced apart, forward stop lugs 21 and rearward stop lugs 23 between which is interposed conventional draft gear 25 and its associated front follower 22. Draft gear 25 is shown only diagrammatically as its specifics have nothing to do with the present invention.

The draft gear 25 and its front follower 22 are embraced, as is conventional, by vertical yoke 24 which is connected to the shank 26 of the coupler 10 by connector pin 28 that is supported by support plate 30 that is secured across the center sill 12, at the level of its undersides 32 and 34, by suitable rivets 36. As usual, the spherically contoured inner end 35 of the coupler seats against the correspondingly contoured force transmitting recess 37 of the front follower 22.

The yoke 24 comprises the usual upper and lower straps or arms 40 and 42 that are suitably apertured as indicated in FIG. 2 to receive the connector pin 28, and that are integrally connected together at the inner end 43 of the yoke by the yoke bight portion 44.

The underside 46 of the yoke lower strap 42 is generally flat or planar in configuration, and at its inner end 48, it is supported by and rides on the conventional yoke wear plate that is replaced, in accordance with the present invention, by the yoke wear plate assembly indicated at 50 in the showing of FIGS. 1 - 4. Conventionally the draft gear rigging involved also includes a flat safety plate 52 secured across the center sill 12 at the level of its undersides 32 and 34, by employing appropriate rivets 54. As indicated in FIG. 2, the safety plate 52 is disposed below the normal working level of the yoke lower strap 42 so as to be out of contact with same.

The conventional yoke wear plate that is not illustrated is customarily secured across the center plate in the same manner as plates 30 and 52, and is indented upwardly so as to dispose the yoke 24 in proper working level alignment with the coupler longitudinally of the center sill (see page 534 of the 1970 Edition of the Car and Locomotive Cyclopedia).

The wear plate assembly 50 comprises planar, totally flat, plate 60 that is free of the aforementioned upward indentation, and that is fixed across the center sill at the level of the center sill undersides 30 and 34, as by employing suitable rivets 62. Plate 60 has applied to same liner 64 which is of molded or extruded one piece construction and is formed from an ultra high molecular weight polymer of dry self lubricating characteristics.

In the preferred embodiment, the polymer is polyethylene having a molecular weight of at least 2,000,000 and no greater than about 10,000,000, as the polymer material in question having a molecular weight much in excess of 10,000,000 becomes too difficult to work.

Polyethylene having the ultra high molecular weight range indicated provides a liner having surfacing that is characterized by resistance to adherence thereto of foreign matter, while being self lubricating in nature and providing a coefficient of sliding or dynamic friction of the yoke surface 46 on the liner on the order of 0.02. The material in question, in addition to being a high strength wear resisting material also is characterized by effecting on the yoke surfacing riding on same a polishing or honing resurfacing action such that after a period of normal use, the yoke surfacing in question takes on a mirror-like finish whereby the wear surface of the yoke in question becomes effectively resistant against further wear. Metal worn off the yoke, during the polishing action in question, seems to embed itself in the liner wear surface, to the extent it remains in the locale of the parts involved. Any foreign matter that is caught between the two surfaces involved also seems to become embedded in the liner surfacing, and thus is positioned to avoid any wearing action on the yoke wear surface involved. As indicated, since the material from which the liner is made resists adherence thereto of foreign matter, such foreign matter does not accumulate on the liner and it is only grit and the like that becomes trapped between the two surfaces that is subject to the embedding action indicated.

The liner 64 in the form of FIGS. 1 - 3 comprises a tubular member 70 formed to define a flat bore 72 that substantially complements the transverse cross-sectional configuration of the plate 60 for ready application thereto. Tubular member 70 is proportioned so that its ends 74 and 76 will be closely adjacent if not in contact with the inner surfaces 17 and 19 of the respective center sill sides 16 and 16A, to maintain the liner 64 centered with respect to the yoke it is to support.

The tubular member 70 has a wall thickness equivalent to that which will support the yoke inner end 43 for proper working alignment with the coupler 10 longitudinally of the center sill, which dimension is approximately $\frac{3}{8}$ths of an inch in practice. This disposes the yoke and the draft gear it embraces in horizontal level alignment with the center line of draft (indicated at 75).

In use, as the coupler 10 is acted on by the usual buff and draft impacts, the draft gear 20 functions in the normal manner to absorb the impacts, which will involve the yoke 24 moving longitudinally of the center sill inwardly and outwardly of same, which involves a sliding of the yoke undersurface 48 on the upper surface 78 of the liner 64. The invention acts to substantially eliminate the usual mechanical wear experienced on conventional yoke and wear plate arrangements by the dry self lubricating characteristics of the material forming the liner 64, and by the gradual forming on the yoke undersurface 48 of the aforementioned mirror-like surfacing which tests have shown to have the effect of making the metal of the yoke resistant to further wear due to relative movement with respect to the liner 64 and its support plate 60.

The wear plate assembly also serves as a sound deadener and impact energy absorber, and thus is particularly useful in the case of caboose and other cars where noise is a problem. Liner 64 avoids the metal to metal contact of conventional arrangements that are a source of much noise pollution due to the banging together of the metal parts involved.

In the wear plate assembly 50A of FIG. 5, the liner 64A, instead of having the relative length shown in FIG. 3, whereby the length of the member 64 substantially complements the spacing between the center sill inside surfaces 17 and 19, the length of the liner 64A is made somewhat in excess of the maximum width of the yoke lower strap 42. To maintain the liner member 64A properly centered with respect to the yoke, lugs 80 are fixed to the plate 60 adjacent either end 74A and 76A of the liner 64A. Liner 64A thus comprises shortened tubular member 70A.

Assembly 50A is otherwise the same as that of FIGS. 1 - 3.

In the embodiment of FIG. 6, the assembly 50B comprises the plate 60 (shown in phantom), which has applied thereto modified liner 64B that is formed from the same material as liners 64 and 64A, but is of channel shaped configuration defining web portion 90 and depending side flanges or ribs 92 and 94 that are spaced apart to receive in a substantially complementary manner the plate 60. The liner 64A has a length comparable to that of liner 64 whereby the inside surfaces 17 and 19 of the center sill maintain the liner in alignment with the yoke. The flanges 92 and 94, keeping in mind that the yoke continuously rests on liner 64A, preclude movement of the liner forwardly and rearwardly of the draft gear pocket.

In this embodiment, if desired the liner 64A may be fixed to the plate 60 by employing suitable bolts on either side of the yoke.

While the wear plate assemblies illustrated are shown applied to a type F coupler application, they are equally applicable to type E coupler applications as replacements for the conventional wear plates therein employed, with like benefits to the yokes involved. The upward indenting or building up of the conventional yoke wear plates for type E coupler equipment, which is similar in amount to that required for type F equipment is thus avoided by doing the proper positioning of the yoke with the indicated thickness of the liner.

It will therefore be seen that the invention provides a wear plate assembly for draft gear rigging yokes which is of simplified nature and yet has the capability of eliminating the wear problem on the yoke and its wear plate that is currently such a problem to the railroad industry.

The invention is equally applicable to new and old equipment, and when applied, not only provides for a dry self lubricating type action, but also a resurfacing of the yoke undersurface which results in both the yoke and its wear plate assembly being protected against undue wear. As the material from which the liner of the invention is made resists adherence thereto of foreign material, the abrasive effect of foreign matter that is usually found in equipment of this type, especially where wet type lubricants are employed, will be largely avoided, with any trapped foreign matter becoming embedded in the liner. The term "foreign matter" in this regard means the dirt, grit, dust, road bed particles and the like that under the car equipment is exposed to in service, as is well known in the art.

Furthermore, the liner of the invention when the car is operating absorbs the energy of impacts against it due to yoke movements relative to it, and in avoiding metal to metal contact between the yoke and its wear plate, also acts as a sound deadener.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In a draft gear rigging for railroad cars having a channel shaped center sill opening downwardly and extending longitudinally of the car, with the rigging mounted at the end of the car and comprising a draft gear applied within the draft gear pocket between stops spaced longitudinally of the car and within the center sill, which draft gear is embraced by a yoke extending longitudinally of the car and operably connected to the car coupler, with the yoke being supported by a wear plate secured at its ends at the underside of the center sill, and with the underside of the yoke riding on the wear plate to dispose the yoke underside at its operative level within the center sill, the improvement wherein:

said wear plate is planar in configuration and parallels and is coplanar with the underside of the center sill, and including a liner interposed between the wear plate upper side and the yoke underside on which the yoke inner end rides, said liner being formed from an ultra high molecular weight polymer of dry self lubricating characteristics characterized by having surfacing that resists adherence thereto of foreign matter but which surfacing resurfaces during use the yoke underside portion that engages the liner for reforming said yoke under surface portion to define a mirror finish, and means for securing the liner to said wear plate for maintaining said liner in place between the yoke and the wear plate.

2. The improvement set forth in claim 1 wherein:

said polymer is polyethylene having a molecular weight lying in the range of from about 2,000,000 to about 10,000,000.

3. In a draft gear rigging for type F interlocking couplers for railroad cars having a channel shaped center sill opening downwardly and extending longitudinally of the car, with the rigging mounted at the end of the car and comprising a draft gear applied within the draft gear pocket between stops spaced longitudinally of the car and within the center sill, which draft gear is embraced by a vertical yoke extending longitudinally of the car and operably connected to the car coupler by a vertical connector pin riding on a support plate connected across the underside of the center sill and supporting the outer end of the yoke, with the inner end of the yoke supported by a wear plate secured at its ends to the underside of the center sill, and with the underside of the yoke riding on the wear plate to dispose the yoke underside at its operative level within the center sill, the improvement wherein:

said wear plate is planar in configuration and parallels and is coplanar with the underside of the center sill, and including a liner interposed between the wear plate upper side and the yoke underside on which the yoke inner end rides, said liner being formed from an ultra high molecular weight polymer of dry self lubricating characteristics characterized by having surfacing that resists adherence thereto of foreign matter but which surfacing resurfaces during use the yoke underside portion that engages the liner for reforming said yoke undersurface portion to define a mirror finish, and means for securing the liner to said wear plate for maintaining said liner in place between the yoke and the wear plate.

4. The improvement set forth in claim 3 wherein:

said polymer is polyethylene having a molecular weight lying in the range of from about 2,000,000 to about 10,000,000.

5. The improvement set forth in claim 4 wherein:

said liner comprises a tubular member received over said wear plate, and including means for centering said liner within the center sill.

6. The improvement set forth in claim 4 wherein:

said liner comprises a channel shaped member received over and embracing said wear plate, said liner including means for centering same within the center sill.

7. The improvement set forth in claim 4 wherein:

the portion of the liner that is interposed between the wear plate and the yoke has a thickness approximating $\frac{3}{8}$ths inch.

* * * * *